US005669564A

United States Patent [19]

Keller et al.

[11] Patent Number: 5,669,564

[45] Date of Patent: Sep. 23, 1997

[54] SPIRALS FOR TRAVERSING A STRAND DURING WINDING AND WINDING APPARATUS INCLUDING THE SAME

[75] Inventors: Edwin C. Keller, Greensboro; Nellie Gaither Benoist, Lexington; David N. Durrell, Lexington; Ronald D. Eaton, Lexington; Linda F. Huffman, Lexington; Vickie L. Kinney, Lexington; John M. Muraco, Clemmons; Peggy S. Perry, Lexington; Arvile K. Phillips, Lexington; Michael S. Ramsey, Lexington; Guy Rogers, Lexington; Steven M. Shaw, Lexington; Steve R. Shipton, Denton; Darrues W. Sutton, Lexington; Stephen M. Walser, Lexington; Foy A. Warfford, Jr., Lexington, all of N.C.

[73] Assignee: PPG Industries, Inc., Pittsburgh, Pa.

[21] Appl. No.: 599,002

[22] Filed: Feb. 9, 1996

[51] Int. Cl.[6] ..... B65H 54/28; B65H 57/28

[52] U.S. Cl. ..... 242/43 R; 242/18 G; 242/158 R

[58] Field of Search ..... 242/43 R, 18 G, 242/158 R

[56] References Cited

U.S. PATENT DOCUMENTS

| | | | |
|---|---|---|---|
| 2,391,870 | 1/1946 | Beach . | |
| 2,947,489 | 8/1960 | Russell | 242/18 G |
| 2,989,258 | 6/1961 | Margason . | |
| 3,041,663 | 7/1962 | Green . | |
| 3,041,664 | 7/1962 | Green . | |
| 3,056,711 | 10/1962 | Frickert . | |
| 3,254,850 | 6/1966 | Martin et al. | 242/18 G |
| 3,273,812 | 9/1966 | Lacasse . | |
| 3,356,304 | 12/1967 | Genson . | |
| 3,685,764 | 8/1972 | Drummond . | |
| 3,784,121 | 1/1974 | Arno et al. . | |
| 3,861,608 | 1/1975 | Mohr et al. . | |
| 3,998,326 | 12/1976 | McKee, Jr. . | |
| 4,025,002 | 5/1977 | Sutton, III et al. . | |
| 4,239,162 | 12/1980 | Barch et al. . | |
| 4,390,647 | 6/1983 | Girgis . | |
| 4,795,678 | 1/1989 | Girgis . | |
| 4,830,647 | 5/1989 | Watabe | 242/18 G X |

OTHER PUBLICATIONS

Encyclopedia of Polymer Science and Technology, vol. 6 (1967) at pp. 505–712.

K. L. Loewenstein, "The Manufacturing Technology of Continuous Glass Fibres", (2d Ed. 1983), pp. 29, 33–45, 47–60, 86–107, 118–120, 122–125, 169–177, 178–179, 182–196, 224–230, 243–295.

*Primary Examiner*—Michael Mansen

*Attorney, Agent, or Firm*—Ann Marie Odorski

[57] ABSTRACT

A spiral for traversing a strand during winding includes: (a) a shaft having a first portion, a second portion and a length therebetween having a midpoint; and (b) a first wing and a second wing. Each wing has a first end, a second end and a curved portion therebetween. The first end of each wing is adjacent to the second end of the other wing and displaces the strand from contact with the second end of the other wing during winding. The first end of each wing can be positioned on the shaft at a distance from the midpoint which is less than a distance from the midpoint at which the second end of each wing is positioned on the shaft; the second end of each wing can be positioned at an angle ranging from about 30 degrees to about 150 degrees overlapping a position of the first end of the other wing and/or the curved portion can have a decreasing radius of curvature from the first end of each wing to the second end of each wing; and/or the curved portion of each wing has a generally uniformly decreasing radius of curvature along the curved portion from the first end of each wing to the second end of each wing and only three of any four points of a locus of points along the curved portion of each wing are coplanar.

30 Claims, 5 Drawing Sheets

10
12
14
16
18
20
22
24
26
28
30
31
32
34
36
38
39
40
42
124
126
128
130
132
134
136
137

SPIRALS FOR TRAVERSING A STRAND DURING WINDING AND WINDING APPARATUS INCLUDING THE SAME

FIELD OF THE INVENTION

The present invention relates generally to apparatus for winding fiber strand and, more particularly, to improved spirals for traversing strand during winding of a package which inhibit strand and spiral component damage and facilitate unwinding of the package.

BACKGROUND OF THE INVENTION

In a conventional winding operation, fiber strands are distributed by a spiral or traverse along the length of a rotating collector or collet to wind the strands in a predetermined pattern to form a wound package. Typically, at least one of the spiral or the collet is reciprocated in a direction parallel to the rotational axis of the collet during winding.

Conventional spirals are disclosed in U.S. Pat. Nos. 2,391,870 and 4,239,162, as well as by K. Loewenstein, *The Manufacturing Technology of Glass Fibers*, (2d Ed. 1983) at pages 188–190, which is hereby incorporated by reference.

U.S. Pat. No. 2,391,870 (Beach), at page 2, col. 2, lines 24–38, discloses a traverse in which each cam or wing extends through slightly more than 180° of a convolution. The inner or lower end of the cam terminates inside (in an axial direction) of the large diameter end of the complementary cam member and is preferably also overlapped by the large diameter end. As shown in FIG. 4 of the Beach patent, the shape of the wing is semi-circular in the end elevational view, i.e., the radius of curvature of the wing is constant along the length of the wing. Also, the locus of points along the curve of the wing lie in a single plane.

As discussed in U.S. Pat. No. 4,239,162 at col. 1, lines 36–56, the Beach traverse can permit the strand to impact the shaft during winding, causing shaft wear and strand breakage. Replacing the shaft is both time-consuming and costly. Shaft replacement and strand breakage result in production loss, increased cost and waste.

Observation of strand behavior during winding using a traverse similar to that disclosed by Beach has revealed that the strand can hesitate at the limit of each spiral throw for about 55 degrees (about 0.005 seconds) in the initial stages of package winding for strand routed to the right of the traverse and in the final stages of package winding for strand routed to the left of the traverse. About 12 inches of yarn or about one-third of the package circumference can be deposited upon the collet during this period.

Strand hesitation can contribute to parallel overlaying of the strands. As used herein, the phrase "parallel overlaying" means any two contiguous wraps of strand on a package formed closely in time and contacting for a significant length without an intervening strand. Parallel overlaying can cause strand-to-strand adhesion, filament breakage and pulling out of rings of strand when unwinding from the inside or outside of a package. Similarly, "throw growth", in which strands overlap the ends of the package, can cause trapped strands and breakage during unwinding of a package.

A spiral is needed which ensures a quicker and more uniform turn-around at the ends of a throw and inhibits contact between the strand and the spiral shaft to decrease strand breakage, trapped strands and shaft wear. As used herein, "turn-around" means reversal of the movement of the strand to travel in an opposite direction from the direction prior to turn-around which is generally parallel to the axis of rotation of the collector or collet.

SUMMARY OF THE INVENTION

The present invention provides a spiral for traversing a strand along the length of an axis of rotation of a rotatable collector during winding of the strand about a surface of the collector, comprising: (a) a shaft having an outer surface, a first portion, a second portion and a length therebetween, the length having a midpoint; and (b) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing during winding, the first end of each wing being positioned on the shaft at a distance from the midpoint which is less than a distance from the midpoint at which the second end of each wing is positioned on the shaft.

The present invention also provides a spiral for traversing a strand along the length of an axis of rotation of a rotatable collector during winding of the fiber about a surface of the collector, comprising: (a) a shaft having an outer surface, a first portion, a second portion and a length therebetween, the length having a midpoint; and (b) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing during winding, the second end of each wing being positioned on the shaft at an angle ranging from about 30 degrees to about 150 degrees overlapping a position of the first end of the other wing.

Also provided by the present invention is a spiral for traversing a strand along the length of an axis of rotation of a rotatable collector during winding of the fiber about a surface of the collector, comprising: (a) a shaft having an outer surface, an axis of rotation, a first portion, a second portion and a length therebetween, the length having a midpoint; and (b) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing during winding, wherein the curved portion of each wing has a generally uniformly decreasing radius of curvature along the curved portion from the first end of each wing to the second end of each wing and only three of any four points of a locus of points along the curved portion of each wing are coplanar and wherein D is a distance measured from the second end of the first wing along the axis of rotation of the shaft to the point X as projected onto the axis of rotation along a line perpendicular to the axis of rotation, R is a radial distance from the axis of rotation of the shaft to a point X on the curved portion of the first wing corresponding to the distance D, and $\Omega$ is an angle between (a) a first plane containing the axis of rotation of the shaft and the second end of the first wing and (b) a second plane containing the axis of rotation of the shaft and the point X, such that as $\Omega$ increases linearly, R increases exponentially and D increases in exponentially increasing increments.

The present invention also provides an apparatus for winding a strand into a multilayered package, comprising:

(a) a strand supply device for supplying a strand to a winder; (b) a spiral for traversing a strand along the length of an axis of rotation of a rotatable collector of a winder during winding of the strand about a surface of the collector, the spiral comprising: (i) a shaft having an outer surface, a first portion, a second portion and a length therebetween, the length having a midpoint; and (ii) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing during winding, the first end of each wing being positioned on the shaft at a distance from the midpoint which is less than a distance from the midpoint at which the second end of each wing is positioned on the shaft; (c) a winder spaced apart from the spiral, the winder comprising the collector adapted to receive the strand from the spiral and wind the strand about the surface of the collector to form a multilayered package thereon; and (d) a reciprocating device for reciprocating at least one of the spiral and the collector in a first direction generally parallel to the axis of rotation of the collector and a second direction opposite to the first direction.

Also provided by the present invention is an apparatus for winding a strand into a multilayered package, comprising: (a) a strand supply device for supplying a strand to a winder; (b) a spiral for traversing a strand along the length of an axis of rotation of a rotatable collector of a winder during winding of the strand about a surface of the collector, the spiral comprising (i) a shaft having an outer surface, a first portion, a second portion and a length therebetween, the length having a midpoint; and (ii) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing during winding, the second end of each wing being positioned on the shaft at an angle ranging from about 30 degrees to about 150 degrees overlapping a position of the first end of the other wing; (c) a winder spaced apart from the spiral, the winder comprising the collector adapted to receive the strand from the spiral and wind the strand about the surface of the collector to form a multilayered package thereon; and (d) a reciprocating device for reciprocating at least one of the spiral and the collector in a first direction generally parallel to the axis of rotation of the collector and a second direction opposite to the first direction.

The present invention provides an apparatus for winding a strand into a multilayered package, comprising: (a) a strand supply device for supplying a strand to a winder; (b) a spiral for traversing a strand along the length of an axis of rotation of a rotatable collector of a winder during winding of the strand about a surface of the collector, the spiral comprising: (i) a shaft having an outer surface, an axis of rotation, a first portion, a second portion and a length therebetween, the length having a midpoint; and (ii) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing during winding, wherein the curved portion of each wing has a generally uniformly decreasing radius of curvature along the curved portion from the first end of each wing to the second end of each wing and only three of any four points of a locus of points along the curved portion of each wing are coplanar, and wherein D is a distance measured from the second end of the first wing along the axis of rotation of the shaft to the point X as projected onto the axis of rotation along a line perpendicular to the axis of rotation, R is a radial distance from the axis of rotation of the shaft to a point X on the curved portion of the first wing corresponding to the distance D, and $\Omega$ is an angle between (i) a first plane containing the axis of rotation of the shaft and the second end of the first wing and (ii) a second plane containing the axis of rotation of the shaft and the point X, such that as $\Omega$ increases linearly, R increases exponentially and D increases in exponentially increasing increments; (c) a winder spaced apart from the spiral, the winder comprising the collector adapted to receive the strand from the spiral and wind the strand about the surface of the collector to form a multilayered package thereon; and (d) a reciprocating device for reciprocating at least one of the spiral and the collector in a first direction generally parallel to the axis of rotation of the collector and a second direction opposite to the first direction.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE DRAWINGS

The spirals and apparatus of the present invention have several advantages, including improved unwinding or payout of strand from a wound package, reduced friction, component wear and strand breakage in the forming process, improved split efficiency of the winding process and reduced differences in length and tension between a plurality of strands during winding to reduce catenary or sag.

Also, the spirals and apparatus of the present invention could possibly reduce tension variations in the bundle and between the individual strands, as well as non-uniform pull on the strands by the winder, thereby reducing the catenary in the bundle and consequent variations in package density, tangling during payout, package collapse and telescoping, and other packaging problems such as those discussed above.

Figures 1, 2:
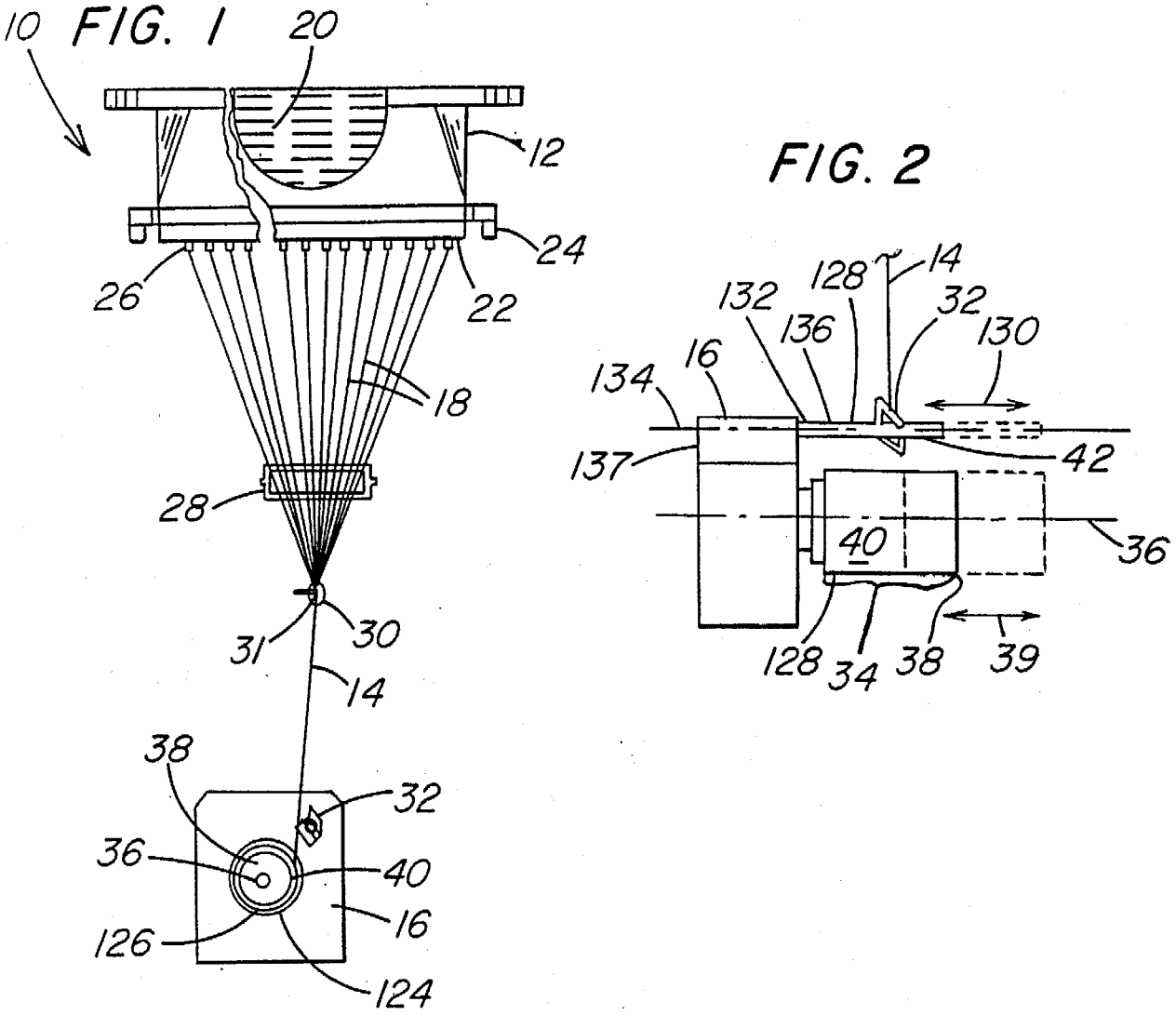
FIG. 1 is a schematic front elevational view of an apparatus for winding strand, in accordance with the present invention.
FIG. 2 is a side elevational view of a portion of the apparatus of FIG. 1.

Referring to the drawings, wherein like numerals indicate like elements throughout, there is shown in FIGS. 1 and 2 a preferred embodiment of a forming apparatus, generally designated 10, in accordance with the present invention.

The forming apparatus 10 includes a strand supply device 12 for supplying at least one strand 14 to a winder 16. As used herein, the term "strand" means at least one substantially continuous fiber 18 or filament.

The present invention will now be discussed generally in the context of its use in the winding of glass fibers. However, one skilled in the art would understand that the present invention is useful in the processing of any of the fibers discussed below.

Referring now to FIG. 1, in the preferred forming apparatus 10 the fibers 18 are supplied from a glass melting furnace or forehearth (not shown) containing a supply of a fiber forming mass or molten glass 20 having a metal bushing 22 attached to the bottom of the forehearth. For clarity in the drawing, the ceramic materials, cooling tubes and fins surrounding the metal bushing have been omitted. Typical forehearths are shown in Loewenstein at pages 86–107, which are hereby incorporated by reference. Alternatively, the forming apparatus 10 can be, for example, a forming device for synthetic textile fibers or strands in which fibers are drawn from nozzles.

Bus bars are connected to an electrical energy source and to the bushing 22 at conductors 24 to heat the bushing 22 and molten glass 20 contained therein. The molten glass 20 is drawn through a plurality of nozzles 26 by a winder 16 to form glass fibers 18.

Typically, the glass fibers 18 are contacted with an applicator 28 to apply a coating or sizing composition thereto to protect the surfaces of the glass fibers from abrasion during processing. As used herein, the terms "size", "sized" or "sizing" refer to the aqueous composition applied to the fibers immediately after formation.

Typical sizing compositions can include as components film-formers, lubricants, coupling agents, emulsifiers and water, to name a few. Examples of suitable sizing compositions are set forth in K. Loewenstein at pages 243–295 (2d Ed. 1983) and U.S. Pat. Nos. 4,390,647 and 4,795,678, each of which is hereby incorporated by reference.

The sizing can be applied in many ways, for example by contacting the filaments with a static or dynamic applicator, such as a roller or belt applicator, spraying or other means. See Loewenstein at pages 169–177, which is hereby incorporated by reference.

The glass fibers 18 are preferably gathered by an alignment device which aligns each of the fibers 18 such that each of the fibers 18 is generally adjacent and coplanar to each other. As used herein when referring to the alignment of the fibers 18, the term "adjacent" means that the fibers 18 are spaced apart or contacting in side-by-side or generally parallel alignment such that the fibers 18 will generally be free of overlap when wound in a layer about the rotatable collector.

The alignment device is generally spaced apart from and below the strand supply device 12 to receive the plurality of fibers 18 from the strand supply device 12. However, the alignment device can receive the plurality of fibers from the supply source at any angle desired. The alignment device preferably aligns the fibers 18 generally perpendicularly to a longitudinal axis of the strand supply device 12.

The alignment device can be any device(s) known to those skilled in the art for aligning or gathering fibers such that each of the fibers is generally parallel and coplanar. Non-limiting examples of suitable alignment devices include rotatable or stationary gathering shoes or a comb, as discussed in Loewenstein at pages 178–179, which are hereby incorporated by reference. The alignment device can be fabricated from any generally rigid natural or synthetic material, such as graphite, cotton and phenolic resin laminate, micarta or other reinforced phenolic laminates.

As shown in FIG. 1, the preferred alignment device is a plurality of graphite split stationary gathering shoes 30 which gather a plurality of fibers 18 to form one or more strands 14 and align the strands 14 at an exit point 31 into a generally adjacent and coplanar arrangement.

While FIG. 1 shows a single strand 14 being drawn from the strand supply device 12, it is understood by those skilled in the art that a plurality of strands 14 comprising two or more strands can be provided, as desired. Preferably, the plurality of strands 14 comprises 2 to 20 strands and, more preferably, 2 to 16 strands. Also, strands 14 can be drawn from a plurality of adjacent bushings.

The apparatus 10 includes a spiral 32, best shown in FIGS. 3–9, for traversing the strand 14 along the length 34 of an axis of rotation 36 of a rotatable collector 38 of the winder 16 during winding of the strand 14 about a surface 40 of the collector 38. The winder 16 and its components are discussed in detail below.

The spiral 32 can be formed from any generally rigid natural or synthetic material which is resistant to abrasive wear, such as for example aluminum, copper, brass, bronze, a reinforced thermoplastic or thermoset material such as micarta or combinations thereof. Non-limiting examples of suitable reinforcements include rigid natural or synthetic material, such as graphite, glass or aramid. In the presently preferred embodiment, the spiral is formed from brass. The individual components of the spiral 32 can be formed from different materials, although preferably the components of the spiral 32 are formed from the same material.

Figure 4:
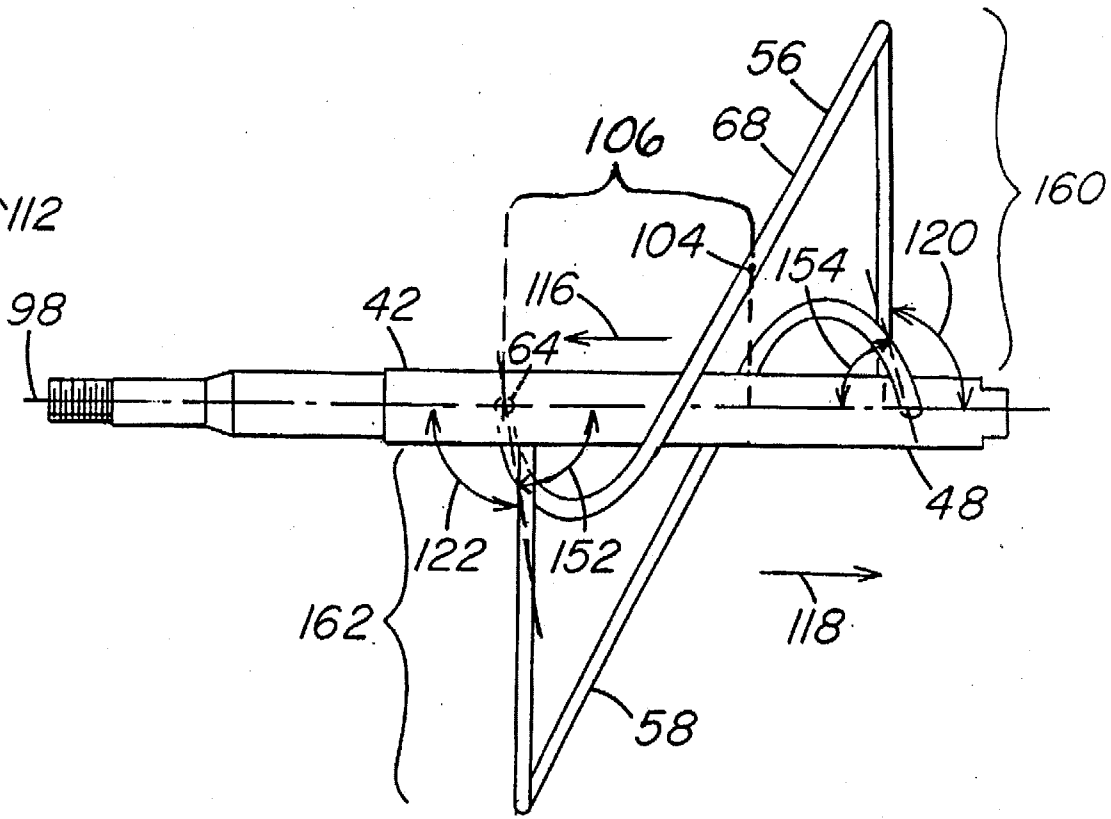
FIG. 4 is a side elevational view of the preferred spiral of FIG. 3, in accordance with the present invention.
Figure 6:
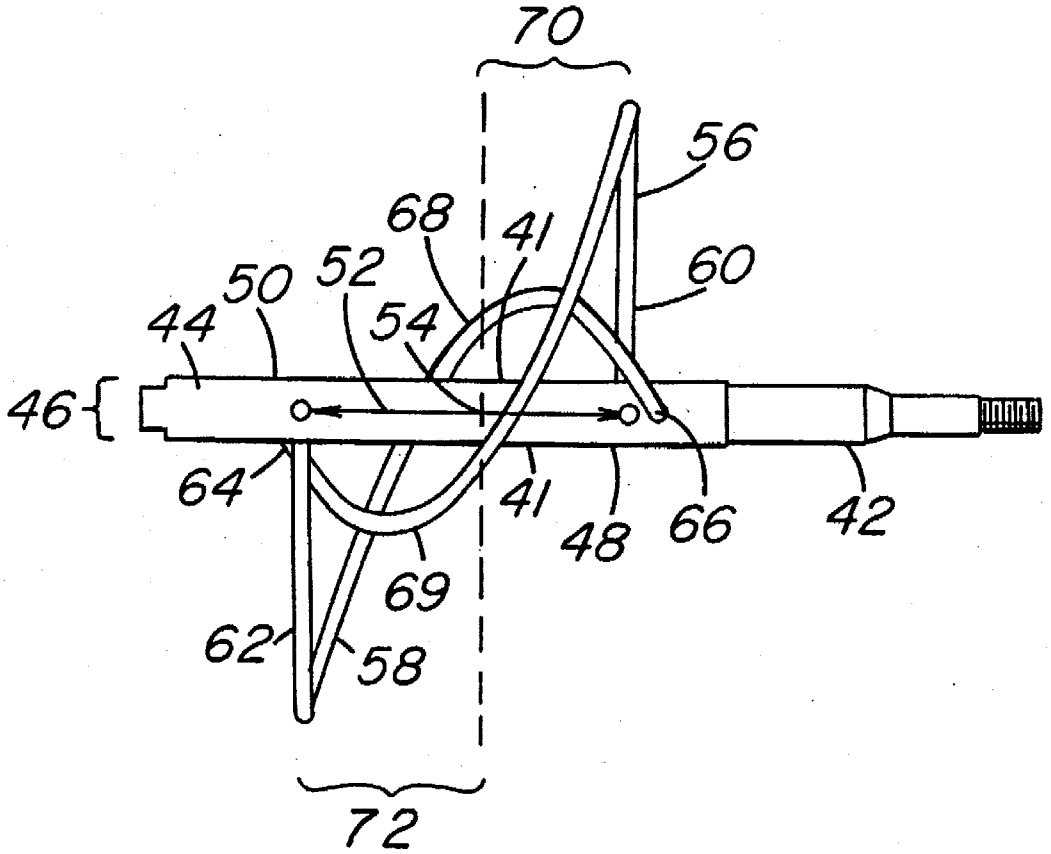
FIG. 6 is a side elevational view of the alternative spiral of FIG. 5, in accordance with the present invention
Figure 5:
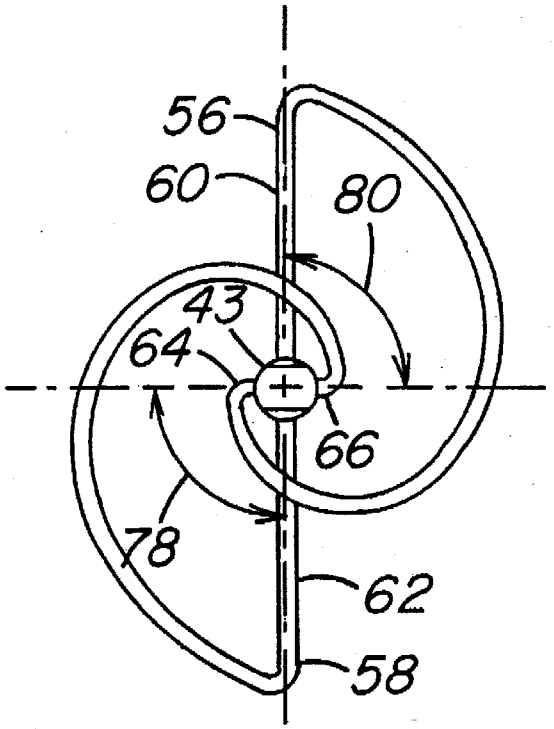
FIG. 5 is an end elevational view of an alternative embodiment of a spiral, in accordance with the present invention.
Figure 8:
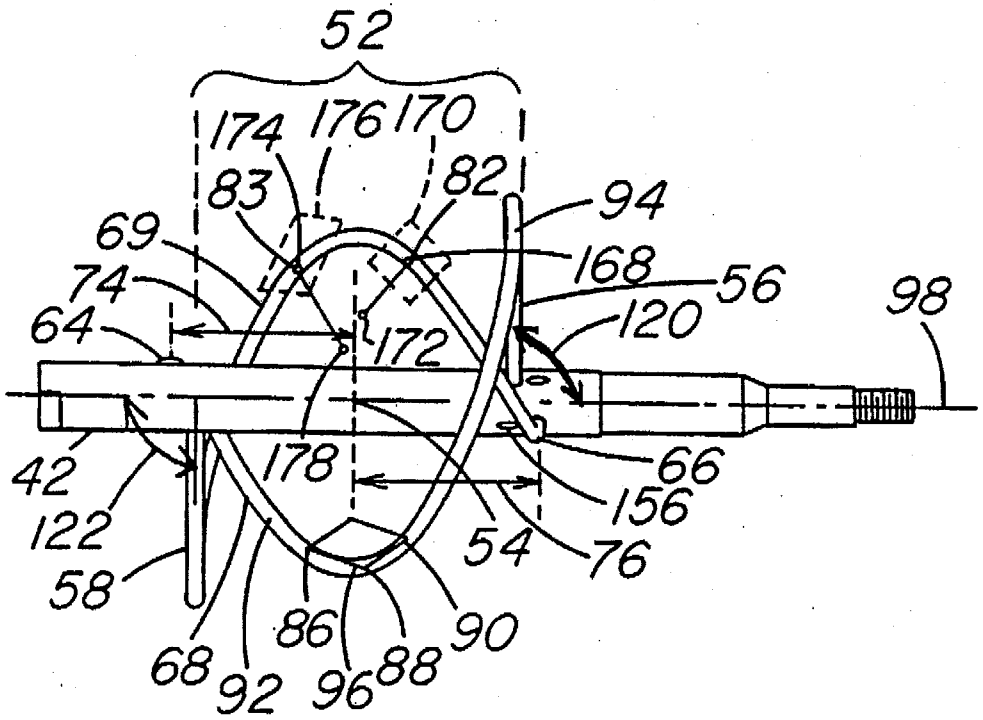
FIG. 8 is a side elevational view of the spiral of FIG. 7, in accordance with the present invention.

As best shown in FIGS. 4, 6 and 8, the spiral 32 comprises a shaft 42 which is preferably generally cylindrical, although the shaft 42 can have any shape desired. The outer surface 44 of the shaft 42 can include surface irregularities such as protuberances, indentations and/or ridges, but preferably is generally smooth to minimize air turbulence during winding. The overall length of the shaft 42 can range from about 0.1 meters to about 1.5 meters, and preferably about 0.2 meters to about 1 meter. The diameter 46 of the shaft 42 can range from about 3 to about 25 millimeters, and preferably is about 12 to about 20 millimeters.

As shown in FIG. 6, the shaft 42 has a first portion 48, an opposed, second portion 50 and a length 52 therebetween. The length 52 between the first portion 48 and the second portion 50 can range from about 2 to about 15 centimeters, and is preferably about 5 to about 10 centimeters. The length 52 has a midpoint 54 in the center thereof.

The midpoint 54 of the length 52 of the shaft 42 is generally aligned and preferably directly below the exit point 31 of the strand 14 from the alignment device. If a plurality of spirals 32 are present on a single shaft 42, each spiral 32 is aligned with a corresponding alignment device such that the midpoint 54 of each length 52 of shaft 42 is aligned with the exit point 31 of the corresponding alignment device. For example, for a two-way split, two spirals 32 would be mounted upon the shaft 42 such that the midpoint 54 of each length 52 of the shaft 42 is aligned with the exit point 31 of a corresponding alignment device. One or more spirals 32 can be mounted upon a single shaft 42, as desired, corresponding to the number of splits desired.

The spiral 32 comprises at least one first wing 56 and at least one second wing 58. Each wing 56, 58 projects radially from the outer surface 44 of the shaft 42 and curves about a portion 41 of the circumference 43 of the shaft 42. In the drawings, two wings (a first wing 56 and a second wing 58) are shown. One skilled in the art would understand that a plurality of first wings 56 and/or a plurality of second wings 58 can be included in the spiral 32 and apparatus 10 of the present invention, if desired. Preferably each of the wings 56, 58 is generally symmetrical about the axis of rotation 98 of the shaft 42, although the wings 56, 58 can have different shapes, as discussed below.

The first wing 56 and second wing 58 are preferably formed from a generally rigid rod or wire-shaped material. The diameter 148 of the first wing 56 can range from about 1 to about 10 millimeters, and preferably about 2 to about 4 millimeters. The diameter 150 of the second wing 58 can range from about 1 to about 10 millimeters, and preferably about 2 to about 4 millimeters. Preferably the diameter 148, 150 of each wing 56, 58 is generally constant along its length, although one skilled in the art would understand that the diameter 148, 150 can vary. Also, it is preferred that the surfaces of the wings 56, 58 are smooth and essentially free of any protuberances or irregularities which can cause strand damage or breakage.

The first wing 56 and second wing 58 are preferably formed from the same material as the shaft 42, although one skilled in the art would understand that the material from which the wings 56, 58 are formed can be any generally rigid material which is resistant to abrasion, such as those materials discussed above for the shaft 42. The first wing 56 and second wing 58 can be formed from different abrasion resistant materials, if desired.

As shown in FIG. 6, the first wing 56 and the second wing 58 each have a corresponding first end 60, 62, a second end 64, 66, and a curved portion 68, 69 therebetween. The first end 60, 62 of each wing 56, 58 is positioned on the shaft 42 adjacent to or proximate the second end 66, 64 of the other wing 58, 56. In other words, the first end 60 of the first wing 56 is positioned adjacent the second end 66 of the second wing 58 and the first end 62 of the second wing 58 is positioned adjacent the second end 64 of the first wing 56.

The first wing 56 and second wing 58 can be positioned on the shaft 42 by securing each wing 56, 58 to the shaft 42, for example by use of a set screw 156 (shown in FIG. 8). Other methods for securing the wings 56, 58 to the shaft, such as welding, would be evident to those skilled in the art and further discussion thereof is not believed to be necessary.

Figure 9:
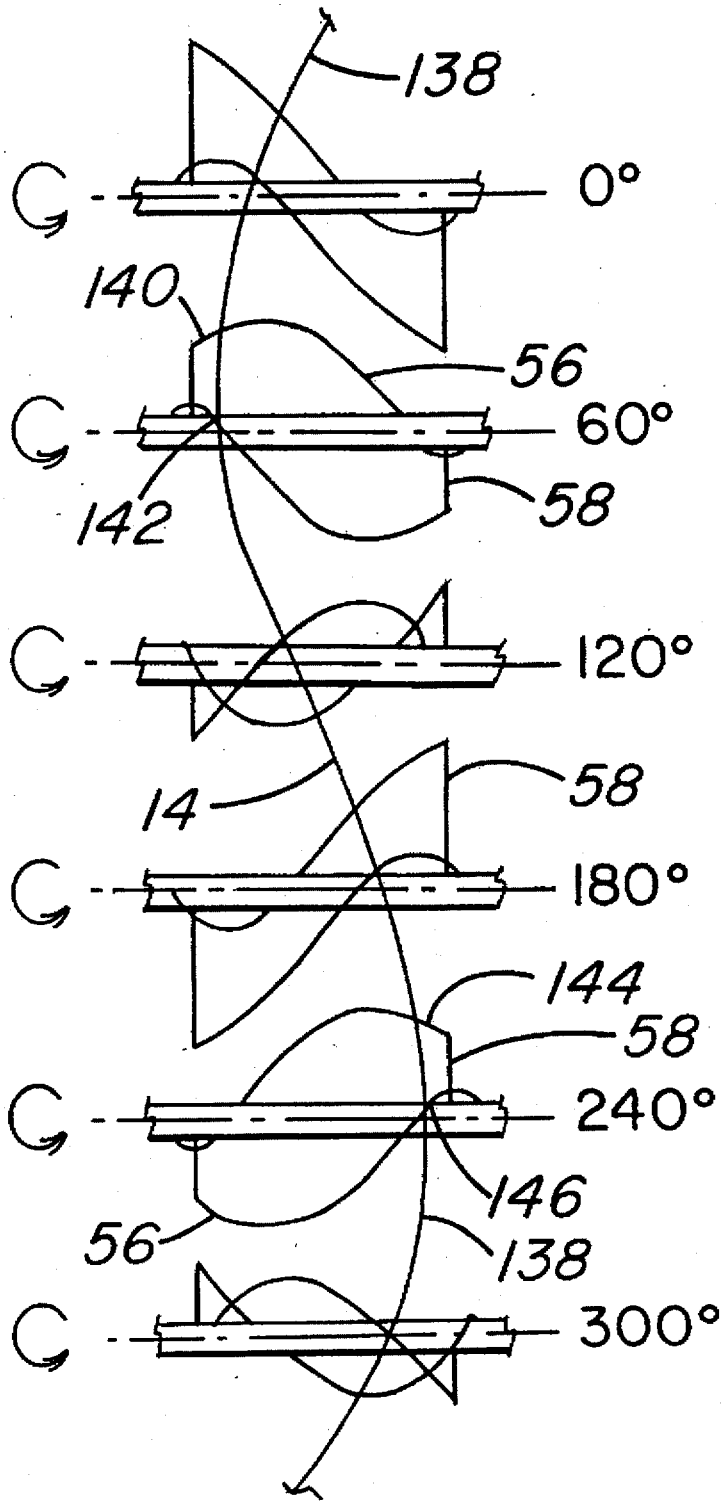
FIG. 9 is a schematic diagram of the strand path during one revolution of the preferred spiral of FIG. 3 in 60° increments, according to the present invention.

During winding, the first end 60 of the first wing 56 displaces the strand 14 from contact with the second end 66 of the second wing 58. Likewise, the first end 62 of the second wing 58 displaces the strand 14 from contact with the second end 64 of the first wing 56. This successive, repetitive displacement in which the strand 14 is alternately displaced by first wing 56 and second wing 58 is best shown in FIG. 9, which shows the approximate strand path 138 during winding through 360° revolution, in 60° increments, of a preferred spiral 42 according to the present invention. At 60° revolution, the approximate points 140, 142 along the first wing 56 and second wing 58, respectively, at which the strand 14 is displaced from the second wing 58 to be guided by the first wing 56 are shown. Similarly, at 240° revolution, the approximate points 144, 146 along the second wing 58 and first wing 56, respectively, at which the strand 14 is displaced from the first wing 56 to be guided by the second wing 58 are shown. This displacement during winding winds the strand 14 in a pattern about the wound package 124 such that parallel overlay typically generated by the spiral component is reduced. One skilled in the art would understand that parallel overlay resulting from other factors such as the collet and spiral speed ratio would not be appreciably influenced by use of the spiral of the present invention.

Preferably, the first end 60, 62 of each wing 56, 58 is generally perpendicular to the axis of rotation 98 of the shaft 42. "Generally perpendicular", when used to refer to the first end 60, 62 of each wing 56, 58 means that the angle 120, 122 (shown in FIG. 4) between the first end 60, 62 of each wing 56, 58 and the axis of rotation 98 of the shaft 42 is between about 75° and about 115° , preferably is about 85° to about 95°, and more preferably is about 90°.

At least a portion of the second end 64, 66 of each wing 56, 58 is also preferably generally perpendicular to the axis of rotation 98 of the shaft 42. As used herein, "generally perpendicular", when used to refer to the second end 64, 66 of each wing 56, 58 means that the angle 152, 154 (shown in FIG. 4) between the second end 64, 66 of each wing 56, 58 and the axis of rotation 98 of the shaft 42 is between about 75° and about 115°, preferably is about 85° to about 95°, and more preferably is about 90°.

The length 160, 162 of the first end 60, 62 of each wing 56, 58 ranges from about 1 millimeters to about 150 millimeters, and preferably about 10 to about 100 millimeters. The length 164, 166 of the second end 64, 66 of each wing 56, 58 ranges from about 1 millimeters to about 150 millimeters, and preferably about 10 to about 100 millimeters.

The distance 70 of the first end 60 of the first wing 56 from the midpoint 54 of the shaft 42 ranges from about 10 to about 65 millimeters, and preferably about 25 to about 50 millimeters. The distance 72 of the first end 62 of the second wing 58 from the midpoint 54 of the shaft 42 ranges from about 10 to about 65 millimeters, and preferably about 25 to about 50 millimeters.

The distance 74 of the second end 64 of the first wing 56 from the midpoint 54 of the shaft 42 ranges from about 15 to about 75 millimeters, and preferably about 30 to about 60 millimeters. The distance 76 of the second end 66 of the second wing 58 from the midpoint 54 of the shaft 42 ranges from about 15 to about 75 millimeters, and preferably about 30 to about 60 millimeters.

In one aspect of the present invention shown in FIGS. 3–9, the first end 60, 62 of each wing 56, 58 is positioned on the shaft 42 at a distance 70, 72 from the midpoint 54 which is less than the distance 74, 76 from the midpoint 54 at which the second end 64, 66 of each wing 56, 58 is positioned on the shaft 42.

In another aspect of the present invention also shown in FIGS. 3–9, the second end 64, 66 of each wing 56, 58 is positioned on the shaft 42 at an angle 78, 80 ranging from about 30 degrees to about 150 degrees overlapping a position of the first end 62, 60, respectively, of the other wing 58, 56. In other words, the second end 64 of the first wing 56 is positioned on the shaft 42 at an angle 78 ranging from about 30 degrees to about 150 degrees overlapping a position of the first end 62 of the second wing 58. Similarly, the second end 66 of the second wing 58 is positioned on the shaft 42 at an angle 80 ranging from about 30 degrees to about 150 degrees overlapping a position of the first end 60 of the first wing 56. In this embodiment, it is preferred that the first end 60, 62 of each wing 56, 58 is positioned on the shaft 42 at a distance 70, 72 from the midpoint 54 which is less than the distance 74, 76 from the midpoint 54 at which the second end 64, 66 of each wing 56, 58 is positioned on the shaft 42.

The angle 78 can range from about 60 degrees to about 120 degrees, preferably about 75 to about 105 degrees, and more preferably 90 degrees overlapping a position of the first end 62 of the second wing 58. Also, the angle 80 can range from about 60 degrees to about 120 degrees, preferably about 75 to about 105 degrees and more preferably about 90 degrees overlapping a position of the first end 60 of the first wing 56.

In another aspect of the present invention also shown in FIGS. 3–9, the curved portion 68, 69 of each wing 56, 58 preferably has a generally uniformly decreasing radius of curvature 82, 83 along the curved portion 68, 69 from the first end 60, 62 of each wing 56, 58 to the second end 64, 66 of each wing 56, 58 and only three of any four points of a locus of points 84, 85 along the curved portion 68, 69 of each wing 56, 58 are coplanar. For example, referring to FIG. 8, points 86, 88 and 90 are coplanar. In this embodiment, any fourth point, such as 92 or 94, selected along the curved portion 68 of wing 56 is not coplanar with plane 96 defined by the points 86, 88 and 90, as shown in FIG. 8.

In this embodiment, it is preferred that the first end 60, 62 of each wing 56, 58 is positioned on the shaft 42 at a distance 70, 72 from the midpoint 54 which is less than the distance 74, 76 from the midpoint 54 at which the second end 64, 66 of each wing 56, 58 is positioned on the shaft 42. Also, it is preferred in this embodiment that the second end 64, 66 of each wing 56, 58 is positioned on the shaft 42 at an angle 78, 80 ranging from about 30 degrees to about 150 degrees overlapping a position of the first end 62, 60, respectively, of the other wing 58, 56.

Figure 7:
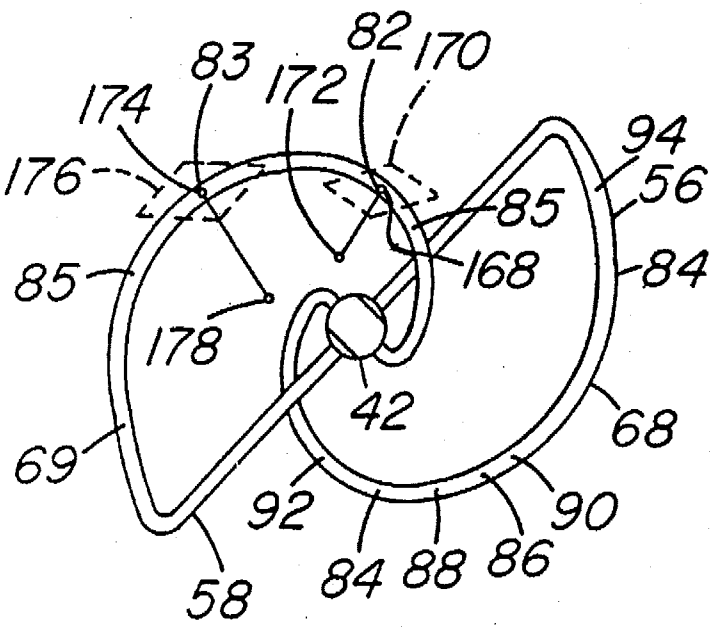
FIG. 7 is an end elevational view of the spiral of FIG. 6, rotated about 45° clockwise, in accordance with the present invention.

The radius of curvature at points along the curved portion 68, 69 with reference to respective tangential planes is shown for example in FIGS. 7 and 8. In FIGS. 7 and 8, the radius of curvature 82 is the radial distance at point 168 from tangential plane 170 to a central axis 172 of the curved portion 69 about that point 168. Likewise, the radius of curvature 83 is the radial distance at point 174 from tangential plane 176 to a central axis 178 of the curved portion 69 about that point 174. The radius of curvature 83 is greater than the radius of curvature 82. Generally, the radius of curvature is greater for those curved portions 68, 69 nearer the first end 60, 62 of the wings 56, 58 than the second end 64, 66 of the wings 56, 58.

The radius of curvature 82, 83 can range in value along the length of the first wing 56 and the second wing 58 from about 5 to about 200 millimeters and preferably about 5 to about 100 millimeters.

Figure 3:
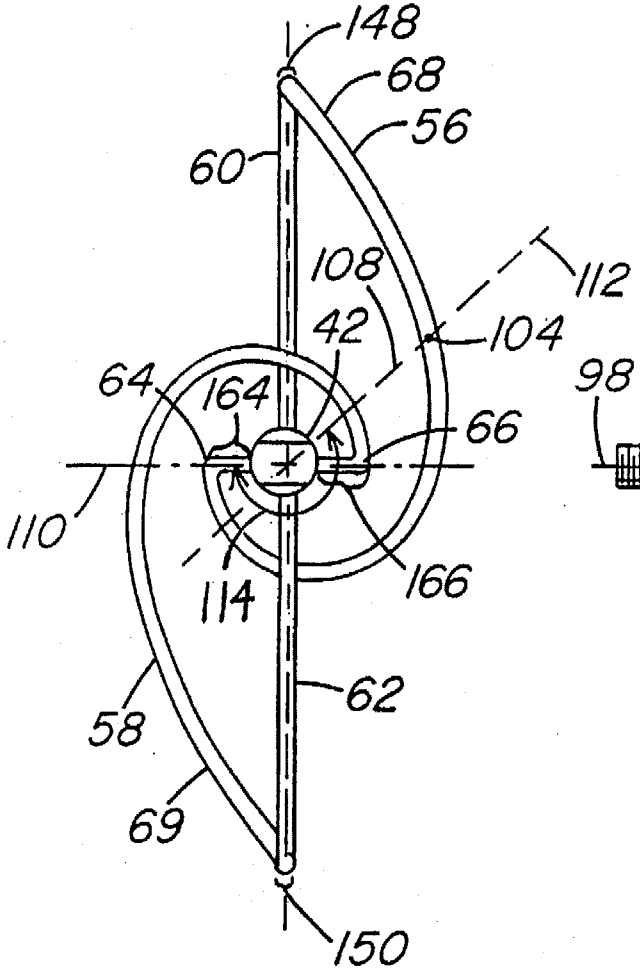
FIG. 3 is an end elevational view of a preferred spiral, in accordance with the present invention.

In a preferred embodiment shown in FIGS. 3 and 4, the curved portion 68, 69 of the wings 56, 58 is given by the following formulas I–IV:

$$R=(0.325+(12^{Y}-1)/4.53608247422)(25.4) \quad \text{(I)}$$

$$D=(10^{\Omega/270}-1)/2.76923076923)(25.4) \quad \text{(II)}$$

$$y=(1/2701)(\Omega/0.1) \quad \text{(III)}$$

where X is a point on the curved portion; R is the radial distance in millimeters from the axis of rotation 98 of the shaft 42 to the point X measured along a line perpendicular to the axis of rotation 98 of the shaft 42; D is the distance measured from the second end 64 of the first wing 56 along the axis of rotation 98 of the shaft 42 to the point X as projected onto the axis of rotation 98 along a line perpendicular to the axis of rotation 98; and Ω is the angle between the plane containing the second end 64 of the first wing 56 and the axis of rotation 98 of the shaft 42 and the plane containing the point X along the curve and the axis of rotation 98 of the shaft 42. One skilled in the art would understand that this formula can also be used to determine the curved portion 69 for the second wing 58 by substituting measurements of the second end 66 of the second wing 58 for the second end 64 of the first wing 56 in the above formula. Also, from derivation of the above formulas, one skilled in the art can determine the radius of curvature at any point along the curved portion 68, 69.

Preferably, in the above formulas R ranges from about 8.25 to about 70 millimeters (about 0.325 to about 2.75 inches); D ranges from 0 to about 82.55 millimeters (3.25 inches); and Ω ranges from 0 to about 330°, and more preferably from 0 to about 270°.

In the embodiments shown in FIGS. 3–9, the curved portion 68 can be determined by plotting points (X) along the curved portion 68 as determined according to the following relationship: where D, R and Ω are as set forth above and, for determining Ω, a first plane P1 contains the axis of rotation 98 of the shaft 42 and the second end 64 of the first wing 56 and a second plane P2 contains the axis of rotation 98 of the shaft 42 and the point X, such that as D increases linearly, R increases exponentially and Ω increases in exponentially decreasing increments. Alternatively, as Ω increases linearly, R increases exponentially and D increases in exponentially increasing increments. One skilled in the art would understand that this relationship can also be used to determine the curved portion 69 for the second wing 58 by substituting measurements of the second end 66 of the second wing 58 for the second end 64 of the first wing 56 in the above formula For example, in FIGS. 3 and 4, where the point X is indicated by 104, D is indicated by 106, R is indicated by 108, P1 is indicated by 110, P2 is indicated by 112 and Ω is therefore 220° as indicated by 114, along the curved portion 68, for points in the direction indicated by arrow 116 from point 104 the value of D will decrease linearly, the value of R will decrease exponentially and the value of Ω will decrease in exponentially increasing increments. Alternatively, as Ω decreases linearly, R decreases exponentially and D decreases in exponentially decreasing increments.

Along the curved portion 68, for points in the direction opposite 116, which are indicated by directional arrow 118, from point 104, the value of D will increase linearly, the value of R will increase exponentially and the value of Ω will increase in exponentially decreasing increments. Alternatively, as Ω increases linearly, R increases exponentially and D increases in exponentially increasing increments.

The forming apparatus also includes a traverse device 132. As used herein, "traverse device" means the device shown in FIG. 2 which generally includes a motor 137, rotatable drive shaft 136 and spiral 32 mounted upon the drive shaft 136 by which the strand 14 is traversed along the length of the axis of rotation 36 of the collector 38.

The shaft 42 of the spiral 32 can be removably secured to the drive shaft 136 by attaching it thereto by use of a reverse threaded connection, for example. Other means for securing the spiral 32 to the drive shaft 136 would be evident to one skilled in the art and further discussion thereof is not believed to be necessary in view of the present disclosure. Rotation of the drive shaft 136 by the motor 137 rotates the spiral 32. The drive shaft 136 can also be reciprocated parallel to the axis of rotation 36 of the collector 38. Suitable AC variable speed motors are well known to those skilled in the art and can include those commercially available from General Electric Company of New York and Electro Mec of Cincinnati, Ohio.

Referring to FIGS. 1 and 2, the forming apparatus 10 also comprises a winder 16 for receiving the strand 14 from the alignment device, advancing and applying a tension to the strand 14, and forming the strand 14 into a wound package 124 about the axis of rotation 36 of the collector 38.

The winder 16 comprises a rotatable package collector 38 or collet having a generally cylindrical surface 40 about which the strand 14 is wound to form a wound package 124. The wound package 124 can optionally be wound upon a tubular support 126 which is removably telescoped onto the collet 38 in FIG. 1.

The winder 16 can be any conventional winder for winding standard forming packages, such as are discussed in K. Loewenstein at pages 182–196, which is hereby incorporated by reference. Suitable winders 16 are commercially available from Precision Machine Works of North Carolina and Dietze and Schell of Germany.

Preferably, the collector 38 is a collet having a collapsible mandrel. The mandrel has a first, expanded position for engaging and retaining the wound package upon the collet and a second, collapsed position for releasing the wound or forming package 124 from the mandrel. The collet is preferably is expanded by a biasing spring and collapsed by injecting compressed air into the collet through a hollow shaft. Other methods and apparatus for expanding and collapsing the collet are understood by those skilled in the art and further discussion thereof is not believed to be necessary in view of the present disclosure.

Preferably, the rotational speed of the collector 38 is about 1000 to about 6000 revolutions per minute (rpm). A substantially constant linear strand collection speed attenuates glass fibers 18 of essentially uniform diameter during formation of the forming package 124. The diameter of each glass fiber can be any of the common fiber or filament designations, such as D through U, having respective diameters as set forth in Loewenstein at page 30.

The strands 14 are wound generally in a criss-cross pattern in layers to form the forming package 124 upon the surface of the tubular support 126. Generally, forming packages are about 6 to about 20 inches in diameter and have a length of about 2 to about 30 inches. Conventional forming package dimensions are set forth in U.S. Pat. Nos. 3,685,764 and 3,998,326, each of which is hereby incorporated by reference. The sides of the forming package 124 are generally tapered as the package 124 is built.

The apparatus 10 also includes a reciprocating device 128 for reciprocating at least one of the spiral 32 and the collector 38 in a first direction generally parallel to the central axis of rotation 36 of the collector 38 and a second direction opposite to the first direction for a distance generally at least about equal to the desired length of the forming package 124. In the preferred embodiment shown in FIGS. 1 and 2, the reciprocating device 128 is the collector 38 itself, which is reciprocated along its central axis 36 in directions indicated by arrow 39.

In an alternative embodiment shown in phantom in FIG. 2, the reciprocating device is the shaft 136 of the traverse device 132 having the spiral 32 mounted thereon which reciprocates in directions indicated by the arrow 130 along a rotational axis 134 of a drive shaft 136 of the traverse device 132. One skilled in the art would understand that either or both of the shaft 136 of the traverse device 132 or the collector 38 can be reciprocated, as desired.

When the forming package 124 is completed, the tubular support 126 having the forming package 124 thereon is removed from the collet and replaced with an empty tube to repeat the process.

The present invention is generally useful in the winding of fibers, filaments, strands or the like of natural or man-made materials. Fibers believed to be useful in the present invention are discussed at length in the *Encyclopedia of Polymer Science and Technology*, Vol. 6 (1967) at pages 505–712, which is hereby incorporated by reference.

Suitable inorganic fibers are discussed in the *Encyclopedia of Polymer Science and Technology*, Vol. 6 at 610–690 and include glass and polycrystalline fibers, such as ceramics including silicon carbide, and carbon or graphite.

The preferred fibers for use in the present invention are glass fibers, a class of fibers generally accepted to be based upon oxide compositions such as silicates selectively modified with other oxide and non-oxide compositions. Useful glass fibers can be formed from any type of fiberizable glass composition known to those skilled in the art, and include those prepared from fiberizable glass compositions such as "E-glass", "A-glass", "C-glass", "D-glass", "R-glass", "S-glass", and E-glass derivatives that are fluorine-free and/or boron-free. Such compositions and methods of making glass filaments therefrom are well known to those skilled in the art and further discussion thereof is not believed to be necessary in view of the present disclosure. If additional information is needed, such glass compositions and fiberization methods are disclosed in K. Loewenstein, "The Manufacturing Technology of Glass Fibres", (2d Ed. 1983) at pages 29, 33–45, 47–60, 118–120 and 122–125, which is hereby incorporated by reference.

Suitable natural materials include those derived directly from animal, vegetable and mineral sources. *Encyclopedia of Polymer Science and Technology*, Vol. 6 at 505–506; 522–542; 691–712. Examples of methods for preparing and processing such natural fibers are also discussed in the *Encyclopedia of Polymer Science and Technology*, Vol. 6 at 709–712. Further discussion thereof is not believed to be necessary in view of the above and the present disclosure. Non-limiting examples of animal and vegetable-derived natural materials include cotton, cellulose, natural rubber, flax, ramie, hemp, sisal and wool. Examples of suitable minerals include mineral wool and basalt.

Suitable man-made fibers can be formed from a fibrous or fiberizable material prepared from natural organic polymers, synthetic organic polymers or inorganic substances. *Encyclopedia of Polymer Science and Technology*, Vol. 6 at 506–507. As used herein, the term "fiberizable" means a material capable of being formed into a generally continuous filament, fiber or strand.

Man-made fibers produced from natural organic polymers are regenerated or derivative. *Encyclopedia of Polymer Science and Technology*, Vol. 6 at 506. A regenerated fiber is formed when a natural polymer or its chemical derivative is dissolved and extruded as a continuous filament which retains, or after fiber forming has regenerated, the chemical nature of the natural polymer. *Encyclopedia of Polymer Science and Technology*, Vol. 6 at 506. An example of a regenerated fiber is a regenerated cellulosic fiber. *Encyclopedia of Polymer Science and Technology*, Vol. 6 at 542–548. A derivative fiber is formed when a chemical derivative of the natural fiber is prepared, dissolved and extruded as a continuous filament which retains the chemical nature of the derivative. *Encyclopedia of Polymer Science and Technology*, Vol. 6 at 506.

Man-made fibers can also be based upon synthetic polymers such as polyamides, polyesters, acrylics, polyolefins, polyurethanes, vinyl polymers, derivatives and mixtures thereof. *Encyclopedia of Polymer Science and Technology*, Vol. 6 at 506.

Suitable man-made fibers can be formed by a variety of polymer extrusion and fiber formation methods, such as for example drawing, melt spinning, dry spinning, wet spinning and gap spinning. Such methods are well known to those skilled in the art and further discussion thereof is not believed to be necessary in view of the present disclosure. If additional information is needed, such methods are disclosed in *Encyclopedia of Polymer Science and Technology*, Vol. 6 at 507–508.

Non-limiting examples of useful polyamide fibers include nylon fibers such as nylon 6 (a polymer of caprolactam), nylon 6,6 (a condensation product of adipic acid and hexamethylenediamine), nylon 12 (which can be made from butadiene) and nylon 10. Many of these nylons are commercially available from E.I. dupont de Nemours and Company of Wilmington, Del. and BASF Corp. of Parsippany, N.J. Other useful polyamides include polyhexamethylene adipamide, polyamide-imides and aramids such as KEVLAR™, which is commercially available from dupont.

Thermoplastic polyester fibers useful in the present invention include those composed of at least 85% by weight of an ester of a dihydric alcohol and terephthalic acid, such as polyethylene terephthalate (for example DACRON™ which is commercially available from dupont and FORTREL™ which is commercially available from Hoechst Celanese Corp. of Summit, N.J.) and polybutylene terephthalate.

Fibers formed from acrylic polymers believed to be useful in the present invention include polyacrylonitriles having at least about 35% by weight acrylonitrile units, and preferably at least about 85% by weight, which can be copolymerized with other vinyl monomers such as vinyl acetate, vinyl chloride, styrene, vinylpyridine, acrylic esters or acrylamide. See *Encyclopedia of Polymer Science and Technology*, Vol. 6 at 559–561. A non-limiting example of a suitable acrylic polymer fiber is ORLON™, a copolymer which contains at least 85% acrylonitrile which is commercially available from dupont.

Useful polyolefin fibers are generally composed of at least 85% by weight of ethylene, propylene, or other olefins. See *Encyclopedia of Polymer Science and Technology*, Vol. 6 at 561–564.

Fibers formed from vinyl polymers believed to be useful in the present invention can be formed from polyvinyl chloride, polyvinylidene chloride (such as SARAN™, which is commercially available from Dow Plastics of Midland, Mich.), polytetrafluoroethylene, and polyvinyl alcohol (such as VINYLON™, a polyvinyl alcohol fiber which has been crosslinked with formaldehyde).

Further examples of thermoplastic fiberizable materials believed to be useful in the present invention are fiberizable polyimides, polyether sulfones, polyphenyl sulfones; polyetherketones, polyphenylene oxides, polyphenylene sulfides and polyacetals.

Suitable elastomeric fibers are synthetic rubbers or spandex polyurethanes in which the fiber-forming substance is a long-chain synthetic polymer comprised of at least 85% by weight of a segmented polyurethane having alternating soft and hard regions in the polymer structure. See *Encyclopedia of Polymer Science and Technology*, Vol. 6 at 564–566 and 573–591. As used herein, the term "elastomeric fiber" means a fiber that will recover from long-range deformations immediately upon removal of the deforming force. *Encyclopedia of Polymer Science and Technology*, Vol. 6 at 564. A commercial spandex fiber is LYCRA™, which is available from dupont.

It is understood that blends or copolymers of any of the above materials and combinations of fibers formed from any of the above materials can be used in the present invention, if desired. Combinations of fibers formed from any of the above organic and inorganic materials can be used in the present invention.

The forming packages of sized fibers are preferably dried at room temperature or at elevated temperatures. Drying of glass fiber forming packages or cakes is discussed in detail in Loewenstein at pages 224–230, which is hereby incorporated by reference. For example, the forming package can be dried in an oven at a temperature of about 104° C. (220° F.) to about 160° C. (320° F.) for about 10 to about 24 hours to produce glass fiber strands having a dried residue of the composition thereon. The temperature and time for drying the glass fibers will depend upon such variables as the percentage of solids in the sizing composition, components of the sizing composition and type of glass fiber. The sizing is typically present on the fibers in an amount between about 0.1 percent and about 5 percent by weight after drying.

Suitable ovens for drying glass fibers are well known to those skilled in the art. The dryer removes excess moisture from the fibers 18 and, if present, cures any curable sizing or secondary coating composition components.

After drying, the sized glass strands can be gathered together into bundles of generally parallel fibers or roving and can be further treated with a secondary coating composition which is different from the sizing composition. The term "secondary coating" refers to a coating composition applied secondarily to one or a plurality of fibers after the sizing composition is applied, and preferably at least partially dried. As used herein, the term "bundle" refers to a plurality of fibers or strands. The secondary coating composition can include one or more of the components of the sizing composition discussed above, and is preferably aqueous-based. Non-limiting examples of suitable secondary coating compositions are disclosed in U.S. Pat. Nos. 4,762,750 and 4,762,751, which are here by incorporated by reference.

The secondary coating composition is applied to at least a portion of the surface of the strands in an amount effective to coat or impregnate the portion of the strands. The secondary coating composition can be conventionally applied by dipping the strand in a bath containing the composition, by spraying the composition upon the strand or by contacting the strand with a static or dynamic applicator such as a roller or belt applicator, for example. The coated strand can be passed through a die to remove excess coating composition from the strand and/or dried as discussed above for a time sufficient to at least partially dry or cure the secondary coating composition.

The strands 14 wound using the spirals and apparatus of the present invention can be used in conventional weaving processes, configured into roving or as a reinforcement for thermoplastic or thermosetting materials, for example.

The operation of the apparatus 10 to wind a package according to the present invention will now be described.

Molten glass 20 received from the bushing 22 is attenuated into fibers 18 from the bushing 22 using a rotating pull roll (not shown). The fibers 18 are gathered and placed into contact with the applicator 28 and aligned as desired in the gathering shoes 30. The strand 14 is wrapped around the collet 38 as rotation of the collet is commenced. When the collet 38 has reached the desired rotational speed, the rotation of the spiral 32 is commenced, the strand 14 is aligned with the spiral 32 and reciprocation of the collet 38 is commenced.

The strand 14 is wrapped about the tubular support 126 while the collet rotates and reciprocates and the spiral 32 rotates, thereby distributing the strand in a predetermined pattern while winding. When the winding of the forming package 124 has been completed, the strands 14 are diverted to be wound about the area of the collet 38 or collecting tube 124 beyond the area upon which the forming package 124 is wound. The strands 14 can be then be diverted to the pull-down roll for subsequent winding about another forming package and the rotation of the spiral 32 and rotation and reciprocation of the collet 38 are ceased to permit removal of the package 124.

The spirals of the present invention permit quicker and more uniform turn-around at the ends of a throw and inhibit contact between the strand and the spiral shaft to decrease strand breakage, trapped strands and shaft wear. The spirals and apparatus of the present invention can improve the unwinding or payout of strand from a wound package, reduce friction, component wear and strand breakage in the forming process, improve the split efficiency of the winding process and reduce differences in length and tension between a plurality of strands during winding to reduce catenary or sag.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore we claim:

1. A spiral for traversing a strand along the length of an axis of rotation of a rotatable collector during winding of the strand about a surface of the collector, comprising:

(a) a shaft having an outer surface, a first portion, a second portion and a length therebetween, the length having a midpoint; and (b) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing for traversing a strand along the length of an axis of rotation of a rotatable collector during winding of the strand about a surface of the collector, the first end of each wing being positioned on the shaft at a distance from the midpoint which is less than a distance from the midpoint at which the second end of each wing is positioned on the shaft.

2. The spiral according to claim 1, wherein the length of the shaft between the first portion and the second portion of the shaft is 2 to 15 centimeters.

3. The spiral according to claim 1, wherein at least one wing is formed from a generally rigid material selected from the group consisting of a metallic material, a reinforced thermoplastic material and a reinforced thermosetting material.

4. The spiral according to claim 3, wherein at least one wing is formed from a metallic material Which is selected from the group consisting of brass, steel, aluminum, copper and bronze.

5. The spiral according to claim 1, wherein the first end of each wing is generally perpendicular to an axis of rotation of the shaft.

6. The spiral according to claim 5, wherein a length of the first portion of each wing is 1 to 150 millimeters.

7. The spiral according to claim 1, wherein the distance of the first end of each wing from the midpoint of the shaft is 10 to 65 millimeters.

8. The spiral according to claim 1, wherein the second end of each wing is generally perpendicular to an axis of rotation of the shaft.

9. The spiral according to claim 8, wherein a length of the second end of each wing is 1 to 150 millimeters.

10. The spiral according to claim 1, wherein the distance of the second end of each wing from the midpoint of the shaft is 15 to 75 millimeters.

11. The spiral according to claim 1, wherein the curved end of each wing has a generally uniformly decreasing radius of curvature along the curved portion from the first end of each wing to the second end of each wing and only three of any four points of a locus of points along the curved end of each wing are coplanar.

12. The spiral according to claim 1, wherein the shaft has an axis of rotation and the shape of the curved portion of a wing selected from the group consisting of the first wing and the second wing is defined by the formulas I–III:

$$R=(0.325+(12^{y}-1)/4.53608247422)(25.4) \quad \text{(I)}$$

$$D=((10^{\Omega/270}-1)/2.76923076923)(25.4) \quad \text{(II)}$$

$$y=(1/2701)(\Omega/0.1) \quad \text{(III)}$$

where X is a point on the curved portion; R is a radial distance in millimeters from the axis of rotation of the shaft to the point X measured along a line perpendicular to the axis of rotation of the shaft; D is a distance measured from the second end of the first wing along the axis of rotation of the shaft to the point X as projected onto the axis of rotation along a line perpendicular to the axis of rotation; and Ω is an angle between a first plane containing the second end of the first wing and the axis of rotation of the shaft and a second plane containing the point X along the curved portion and the axis of rotation of the shaft.

13. The spiral according to claim 1, wherein the shaft has an axis of rotation and D is a distance measured from the second end of the first wing along the axis of rotation of the shaft to a point X as projected onto the axis of rotation along a line perpendicular to the axis of rotation, R is a radial distance from the axis of rotation of the shaft to a point X on the curved portion of the first wing corresponding to the distance D, and Ω is an angle between (a) a first plane containing the axis of rotation of the shaft and the second end of the first wing and (b) a second plane containing the axis of rotation of the shaft and the point X, such that as D increases linearly, R increases exponentially and Ω increases in exponentially decreasing increments.

14. The spiral according to claim 1, wherein the shaft has an axis of rotation and D is a distance measured from the second end of the first wing along the axis of rotation of the shaft to a point X as projected onto the axis of rotation along a line perpendicular to the axis of rotation, R is a radial distance from the axis of rotation of the shaft to a point X on the curved portion of the first wing corresponding to the distance D, and Ω is an angle between (a) a first plane containing the axis of rotation of the shaft and the second end of the first wing and (b) a second plane containing the axis of rotation of the shaft and the point X, such that as Ω increases linearly, R increases exponentially and D increases in exponentially increasing increments.

15. The spiral according to claim 1, wherein the second end of the first wing is positioned on the shaft at an angle ranging from 30 degrees to 150 degrees overlapping a position of the first end of the second wing.

16. The spiral according to claim 1, wherein the second end of the second wing is positioned on the shaft at an angle ranging from 30 degrees to 150 degrees overlapping a position of the first end of the first wing.

17. A spiral for traversing a strand along the length of an axis of rotation of a rotatable collector during winding of a fiber about a surface of the collector, comprising:

(a) a shaft having an outer surface, a first portion, a second portion and a length therebetween, the length having a midpoint; and (b) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing for traversing a strand along the length of an axis of rotation of a rotatable collector during winding of the strand about a surface of the collector, the second end of each wing being positioned on the shaft at an angle ranging from about 30 degrees to about 150 degrees overlapping a position of the first end of the other wing.

18. The spiral according to claim 17, wherein the curved portion of each wing has a generally uniformly decreasing radius of curvature along the curved portion from the first end of each wing to the second end of each wing and only three of any four points of a locus of points along the curved portion of each wing are coplanar.

19. The spiral according to claim 17, wherein the shaft has an axis of rotation and the shape of the curved portion of a wing selected from the group consisting of the first wing and the second wing is defined by the formulas I–III:

$$R=(0.325+(12^{y}-1)/4.53608247422)(25.4) \quad \text{(I)}$$

$$D=((10^{\Omega/270}-1)/2.76923076923)(25.4) \quad \text{(II)}$$

$$y=(1/2701)(\Omega/0.1) \quad \text{(III)}$$

where X is a point on the curved portion; R is a radial distance in millimeters from the axis of rotation of the shaft to the point X measured along a line perpendicular to the axis of rotation of the shaft; D is a distance measured from the second end of the first wing along the axis of rotation of the shaft to the point X as projected onto the axis of rotation along a line perpendicular to the axis of rotation; and Ω is an angle between a first plane containing the second end of the first wing and the axis of rotation of the shaft and a second plane containing the point X along the curved portion and the axis of rotation of the shaft.

20. The spiral according to claim 17, wherein the shaft has an axis of rotation and D is a distance measured from the second end of the first wing along the axis of rotation of the shaft to a point X as projected onto the axis of rotation along a line perpendicular to the axis of rotation, R is a radial distance from an axis of rotation of the shaft to a point X on the curved portion of the first wing corresponding to the distance D, and Ω is an angle between (a) a first plane containing the axis of rotation of the shaft and the second end of the first wing and (b) a second plane containing the axis of rotation of the shaft and the point X, such that as D increases linearly, R increases exponentially and Ω increases in exponentially decreasing increments.

21. The spiral according to claim 17, wherein the shaft has an axis of rotation and D is a distance measured from the second end of the first wing along the axis of rotation of the shaft to a point X as projected onto the axis of rotation along a line perpendicular to the axis of rotation, R is a radial distance from an axis of rotation of the shaft to a point X on the curved portion of the first wing corresponding to the distance D, and Ω is an angle between (a) a first plane containing the axis of rotation of the shaft and the second end of the first wing and (b) a second plane containing the axis of rotation of the shaft and the point X, such that as Ω increases linearly, R increases exponentially and D increases in exponentially increasing increments.

22. The spiral according to claim 17, wherein the second end of each wing is positioned on the shaft at an angle ranging from 60 degrees to 120 degrees overlapping a position of the first end of the other wing.

23. The spiral according to claim 22, wherein the second end of each wing is positioned on the shaft at an angle of 90 degrees overlapping a position of the first end of the other wing.

24. A spiral for traversing a strand along the length of an axis of rotation of a rotatable collector during winding of the fiber about a surface of the collector, comprising:

(a) a shaft having an outer surface, an axis of rotation, a first portion, a second portion and a length therebetween, the length having a midpoint; and (b) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing for traversing a strand along the length of an axis of rotation of a rotatable collector during winding of the strand about a surface of the collector, wherein the curved portion has a generally uniformly decreasing radius of curvature along the curved portion from the first end of each wing to the second end of each wing and only three of any four points of a locus of points along the curved portion of each wing are coplanar, and wherein D is a distance measured from the second end of the first wing along the axis of rotation of the shaft to a point X as projected onto the axis of rotation along a line perpendicular to the axis of rotation, R is a radial distance from the axis of rotation of the shaft to a point X on the curved portion of the first wing corresponding to the distance D, and Ω is an angle between (a) a first plane containing the axis of rotation of the shaft and the second end of the first wing and (b) a second plane containing the axis of rotation of the shaft and the point X, such that as Ω increases linearly, R increases exponentially and D increases in exponentially increasing increments.

25. The spiral according to claim 24, wherein the shaft has an axis of rotation and the shape of the curved portion of a wing selected from the group consisting of the first wing and the second wing is defined by the formulas I–III:

$$R=(0.325+(12^{y}-1)/4.53608247422)(25.4) \quad \text{(I)}$$

$$D=((10^{\Omega/270}-1)/2.76923076923)(25.4) \quad \text{(II)}$$

$$y=(1/2701) \quad \text{(III)}.$$

26. An apparatus for winding a strand into a multilayered package, comprising:

(a) a strand supply device for supplying a strand to a winder;

(b) a spiral for traversing a strand along the length of an axis of rotation of a rotatable collector of a winder during winding of the strand about a surface of the collector, comprising:

(i) a shaft having an outer surface, a first portion, a second portion and a length therebetween, the length having a midpoint; and (ii) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing for traversing a strand along the length of an axis of rotation of a rotatable collector during winding of the strand about a surface of the collector, the first end of each wing being positioned on the shaft at a distance from the midpoint which is less than a distance from the midpoint at which the second end of each wing is positioned on the shaft;

(c) a winder spaced apart from the spiral, the winder comprising the collector adapted to receive the strand from the spiral and wind the strand about the surface of the collector to form a multilayered package thereon; and (d) a reciprocating device for reciprocating at least one of the spiral and the collector in a first direction generally parallel to the axis of rotation of the collector and a second direction opposite to the first direction.

27. The spiral according to claim 26, wherein the strand comprises a plurality of individual fibers.

28. The spiral according to claim 27, wherein the fibers are glass fibers.

29. An apparatus for winding a strand into a multilayered package, comprising:

(a) a strand supply device for supplying a strand to a winder;

(b) a spiral for traversing a strand along the length of an axis of rotation of a rotatable collector of a winder during winding of the strand about a surface of the collector, comprising:

(i) a shaft having an outer surface, a first portion, a second portion and a length therebetween, the length having a midpoint; and (ii) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing for traversing a strand along the length of an axis of rotation of a rotatable collector during winding of the strand about a surface of the collector, the second end of each wing being positioned on the shaft at an angle ranging from about 30 degrees to about 150 degrees overlapping a position of the first end of the other wing;

(c) a winder spaced apart from the spiral, the winder comprising the collector adapted to receive the strand from the spiral and wind the strand about the surface of the collector to form a multilayered package thereon; and (d) a reciprocating device for reciprocating at least one of the spiral and the collector in a first direction generally parallel to the axis of rotation of the collector and a second direction opposite to the first direction.

30. An apparatus for winding a strand into a multilayered package, comprising:

(a) a strand supply device for supplying a strand to a winder;

(b) a spiral for traversing a strand along the length of an axis of rotation of a rotatable collector of a winder during winding of the strand about a surface of the collector, comprising:

(i) a shaft having an outer surface, an axis of rotation, a first portion, a second portion and a length therebetween, the length having a midpoint; and (ii) a first wing and a second wing, each wing projecting radially from the outer surface of the shaft and comprising a first end, a second end and a curved portion therebetween, the first end of each wing being adjacent to the second end of the other wing, the first end of each wing for displacing the strand from contact with the second end of the other wing for traversing a strand along the length of an axis of rotation of a rotatable collector during winding of the strand about a surface of the collector, wherein the curved portion of each wing has a generally uniformly decreasing radius of curvature along the curved portion from the first end of each wing to the second end of each wing and only three of any four points of a locus of points along the curved portion of each wing are coplanar, and wherein D is a distance measured from the second end of the first wing along the axis of rotation of the shaft to a point X as projected onto the axis of rotation along a line perpendicular to the axis of rotation, R is a radial distance from the axis of rotation of the shaft to a point X on the curved portion of the first wing corresponding to the distance D, and $\Omega$ is an angle between (i) a first plane containing the axis of rotation of the shaft and the second end of the first wing and (ii) a second plane containing the axis of rotation of the shaft and the point X, such that as $\Omega$ increases linearly, R increases exponentially and D increases in exponentially increasing increments;

(c) a winder spaced apart from the spiral, the winder comprising the collector adapted to receive the strand from the spiral and wind the strand about the surface of the collector to form a multilayered package thereon; and (d) a reciprocating device for reciprocating at least one of the spiral and the collector in a first direction generally parallel to the axis of rotation of the collector and a second direction opposite to the first direction.

* * * * *